United States Patent [19]

Beeche

[11] 4,253,548

[45] Mar. 3, 1981

[54] FOLDING SCAFFOLD SYSTEM

[76] Inventor: Gregory L. Beeche, R.D. #2, Smith Rd., Mechanicville, N.Y. 12118

[21] Appl. No.: 90,017

[22] Filed: Oct. 31, 1979

[51] Int. Cl.[3] ..... E04G 3/10

[52] U.S. Cl. ..... 182/142; 182/119; 182/150; 182/113

[58] Field of Search ..... 182/142, 143, 150, 163, 182/164, 119, 118, 152, 40, 115, 113

[56] References Cited

U.S. PATENT DOCUMENTS

| | | | |
|---|---|---|---|
| 213,686 | 3/1879 | Phillips | 182/163 |
| 216,433 | 6/1879 | Metz | 182/115 |
| 375,779 | 1/1888 | Smith | 182/40 |
| 3,052,315 | 9/1962 | Jones | 182/150 |
| 3,751,863 | 8/1973 | Lyons | 182/152 |
| 3,854,550 | 12/1974 | Shingler | 182/142 |
| 3,951,232 | 4/1976 | Okada | 182/142 |

OTHER PUBLICATIONS

Louisville Scaffold Hanging System Brochure, 12–67.

*Primary Examiner*—Reinaldo P. Machado
*Attorney, Agent, or Firm*—Heslin, Irwin & Nieman

[57] ABSTRACT

A chain of end support sections are foldably linked together and hang vertically from either side of a horizontal support beam. The beam is attached to a pair of suspension cables through two motorized grip hoists rigidly attached to the beam and the cables then hang downwardly along the chains of end support sections to the ground. Work platforms extend horizontally between the end support sections and can move vertically independently of the end support sections. Means are provided for selectively attaching the ends of any work platform to the cables or the end support sections thereby enabling the independent movement of the end support sections and the work platforms during erection and disassembly of the scaffold system.

20 Claims, 7 Drawing Figures

FOLDING SCAFFOLD SYSTEM

BACKGROUND AND SUMMARY OF THE INVENTION

This invention relates to scaffolding systems and, more particularly, relates to systems of the type comprised of modular units which can be readily collapsed and folded into compact bundles when not in use.

There are many applications which require the use of multi-stage scaffold systems. For example, modern buildings are often constructed with the use of sheet metal panels as siding and a multi-stage scaffold system is normally used to install the siding on the building.

A great deal of time is involved in the assembly and dismantling of conventional multi-stage scaffold systems. This is due to the fact that scaffold systems typically involve the use of a plurality of parts of various kinds which must be individually connected and disconnected during assembly and disassembly of the scaffold. This circumstance, of course, adds cost to the job being performed because it involves the use of several men for long periods of time.

Another disadvantage of existing scaffold systems is that the various parts of the system can become scattered about during disassembly or during transport to a new building location. The storage of these parts tends to take up more space than is really necessary due to the lack of any scheme for their convenient and compact storage when not in use.

Still another disadvantage associated with many scaffold systems is the need to have a variety of tools such as wrenches, screwdrivers and pliers available during assembly and disassembly.

Still another disadvantage associated with existing scaffolding systems is the inability to individually change the levels of the various work platforms located thereon without dismantling a substantial part of the system itself.

The invention described herein overcomes all of the disadvantages described above. Briefly, this invention concerns itself with a cable-suspended scaffold system which employs a plurality of work platforms in combination with a chain of foldably linked end support sections in an operative relationship which permits the scaffold system to be collapsed into a relatively small bundle for storage and transportation and unfolded into its erected state for use at the building site. The system employs a method and an apparatus which permits the various work platforms to be selectively suspended from either the supporting cable or the end support sections. When the platforms are suspended from the cable, the end support sections can be drawn upwardly independently of them during assembly and each work platform can be selectively attached to the end support sections as desired levels are reached. The mechanical relationship of the work platforms and end support sections in such that they may be collapsed relatively quickly into a folded and stacked bundle which is very compact and easy to transport. While the system is in use, the levels of individual work platforms can be changed without dismantling the scaffold system.

BRIEF DESCRIPTION OF THE DRAWINGS

Referring now to FIG. 1, scaffold system 10 is shown to be suspended on a pair of cables 12. Cables 12 are shown as being suspended from a pair of booms 14 which would be associated with a roof fixture of some type having sufficient counterweights to support scaffolding system 10 and the load to be carried thereby.

Figure 1:
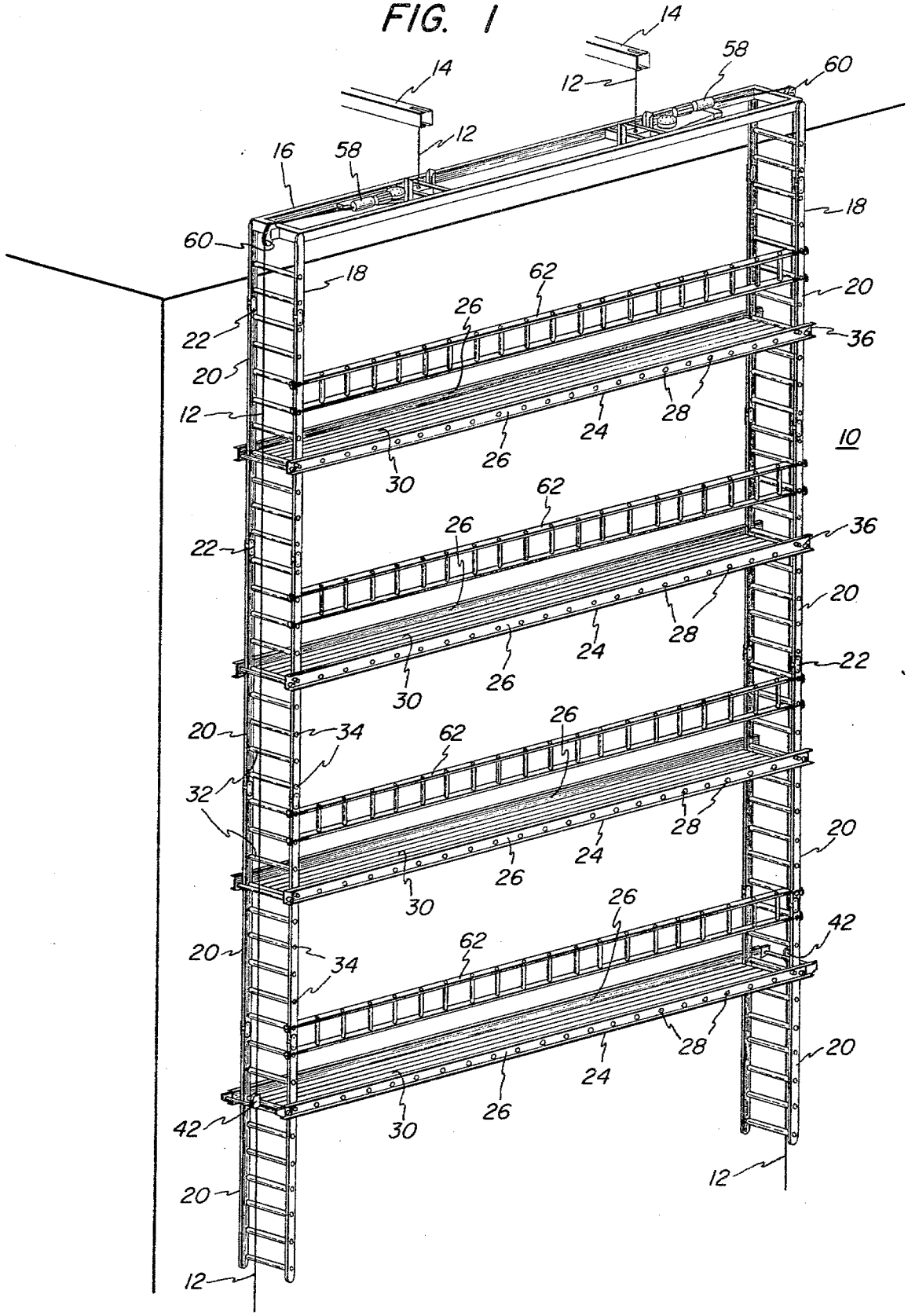
FIG. 1 is a perspective view of the invention shown to be hanging along the side of a building.

End support beam 16 is shown at the top of scaffolding system 10 as a generally rectangular frame. Connected at either end of end support beam 16 are end support columns 18. A series of end support sections 20 are hung in a chain from each end support column 18. The connection between each end support section 20 and between the top end support section and end support column 18 are made by links 22, shown in detail in FIG. 3. The construction of each link 22 is such that each end support section 20 can be pivoted about either end through an angle of about 180°. This permits the end support sections to be collapsed and folded into the configuration shown in FIGS. 2A and 2B. A series of work platforms 24 are supported at their ends by end support sections 20. Each work platform has a pair of kick plates 26 held in a spaced apart relationship by rungs 28, the ends of which are shown at uniform intervals across the entire length of work platforms 24. The rungs 28 support work platform flooring 30.

Figure 3:
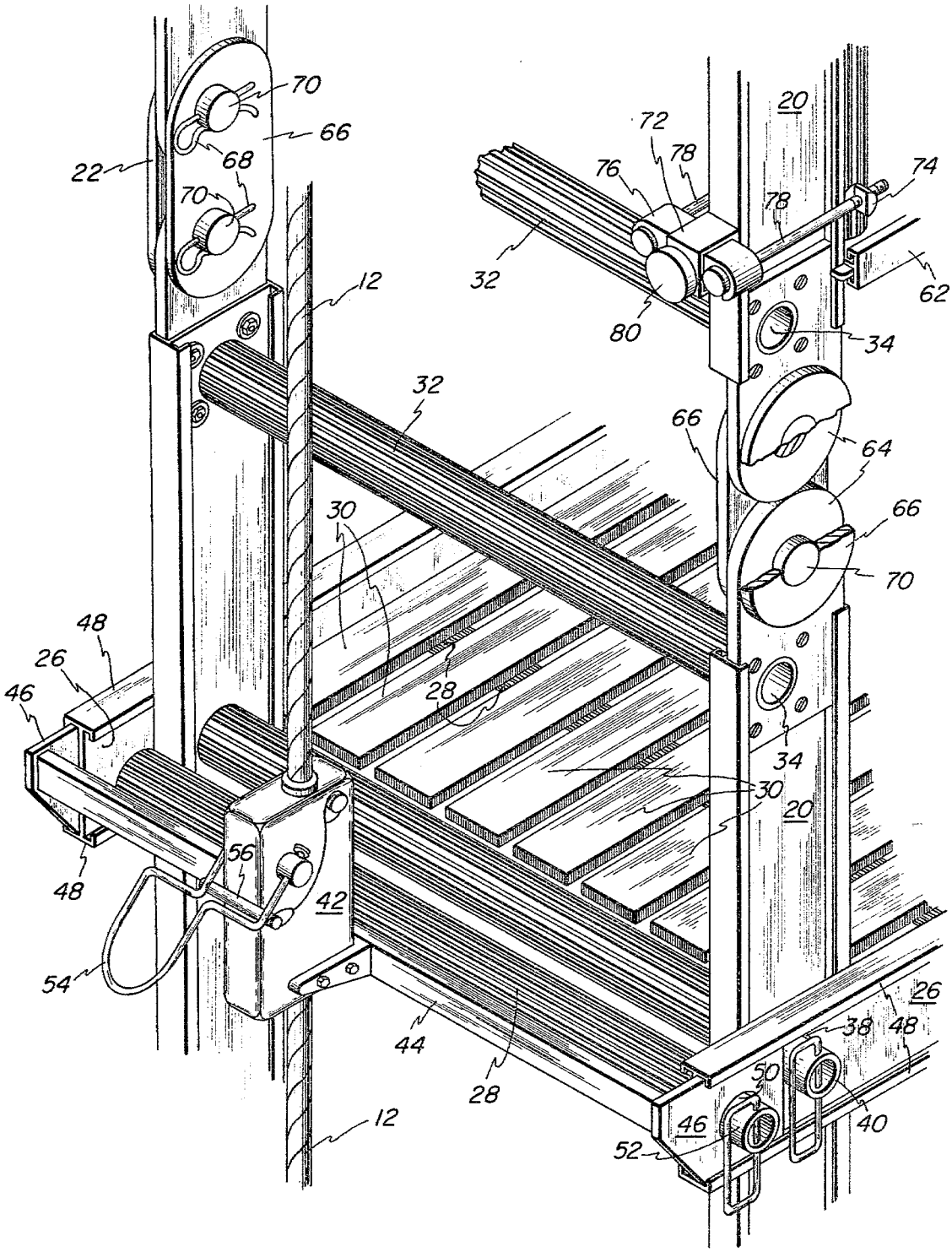
FIG. 3 is an enlarged perspective view of a portion of the invention, with parts broken away, taken at the left end of the bottom work platform of FIG. 1.

Each end support section 20 may be constructed as a ladder having hollow rungs 32 thereby providing a series of end support holes 34 passing completely through each end support section at the location of each rung. In the same way, a hole is formed through each work platform 24 at the location of each platform rung 28. The holes formed at each end rung 28 on each platform 24 may be referred to as cable support holes 36 (see FIG. 1). A structural support hole 38 is provided, as shown in FIG. 3, through each kick plate 26 at a convenient location inwardly of each end rung 28. During erection of scaffold system 10, each structural support hole 38 on the kick plate is aligned with an end support hole 34 in the associated end support section 20 and a structural support pin 40 is then inserted. Structural support pin 40 is long enough to pass completely through both kick plates.

In FIG. 1, there is also shown a cable clamp 42 at either end of the lowest platform 24, the one on the left being shown in more detail in FIG. 3. Clamp 42 is mounted on a bracket 44 having end plates 46 on either side. End plates 46 fit slideably over the outside surfaces of kick plates 26 and slideably within the flanges 48 of kick plates 26. Each end plate 46 is provided with a bracket support hole 50. The location of each bracket hole 50 is such that it may be aligned with a cable support hole 36. When these holes are so aligned, a cable support pin 52 may be inserted, as best shown in FIG. 3. Cable support pin 52 may be identical to structural support pin 40, so long as it has sufficient length to pass completely through both end plates 46 of bracket 44.

Cable clamp 42 is provided with an operating handle 54 normally biased in a "down" position. In FIG. 3, it is shown in the "up" position. When operating handle 54 is up, as shown, the cable 12 is free to pass through cable clamp 42. Otherwise, cable 12 is locked against movement through clamp 42. It is held in the up position by handle pin 56 which may be removed when desired. Cable clamp 42 may be of any suitable type commercially available. It will be appreciated that when bracket support hole 50 is aligned with cable support hole 36 and cable support pin 52 is in place and operating handle 54 is in the down position and structural pin 40 is removed, the associated end of platform 24 would then be supported by cable 12. In this condition, platform 24 may be said to be "clamped" to cable 12 and "released" from its associated end support section 20. In this condition, there may be relative movement between end support section 20 and work platform 24 such that work platform 24 could, in effect, be placed at different levels vertically along end support sections 20. It will be understood that ample clearance must be provided for this purpose between the end of platform flooring 30 and end rung 28.

On the other hand, with structural support pin 40 in place, and either removing cable support pin 52 and separating bracket 44 from platform 24 or raising operating handle 54, then platform 24 would be structurally supported by the chain of end support sections 20 which, in turn, would be hanging from end support beam 16. In this condition, a platform 24 may be said to be "pinned" to its associated end support section 20.

A pair of motorized cable hoists 58 are rigidly mounted within end support beam 16. Each cable 12 extends downwardly from a boom 14 and passes around a suitable sheave (not shown), thereby making a substantially right angle turn into its associated cable hoist 58. After passing through cable hoist 58, cable 12 extends to its associated end of support beam 16 where it again passes around a suitable sheave 60 from which it extends downwardly toward the ground. Cable hoists 58 may be of any suitable type adapted to grip and hold cable 12 when not operating and to draw cable 12 through themselves in either direction selectively when operated. I have found the power hoist manufactured and sold under the trademark GRIPWINCH by Griphoist, Inc. of Westwood, Mass., to be suitable for this purpose, this hoist being described in that company's brochure no. P/923-05/77.

Figure 2A:
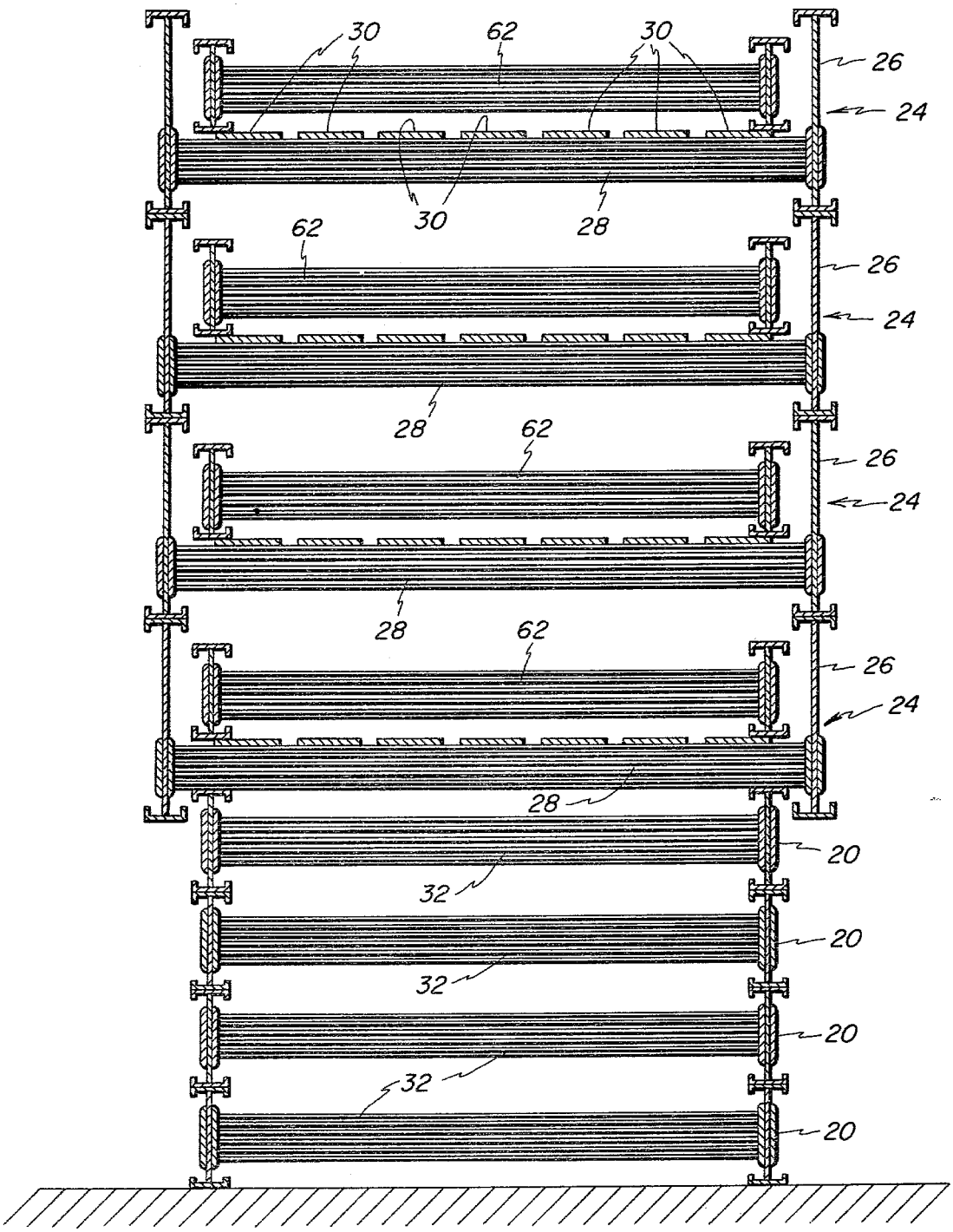
FIG. 2A is a central sectional view of the invention in its collapsed and folded state, certain parts being removed for simplicity.
Figure 2B:
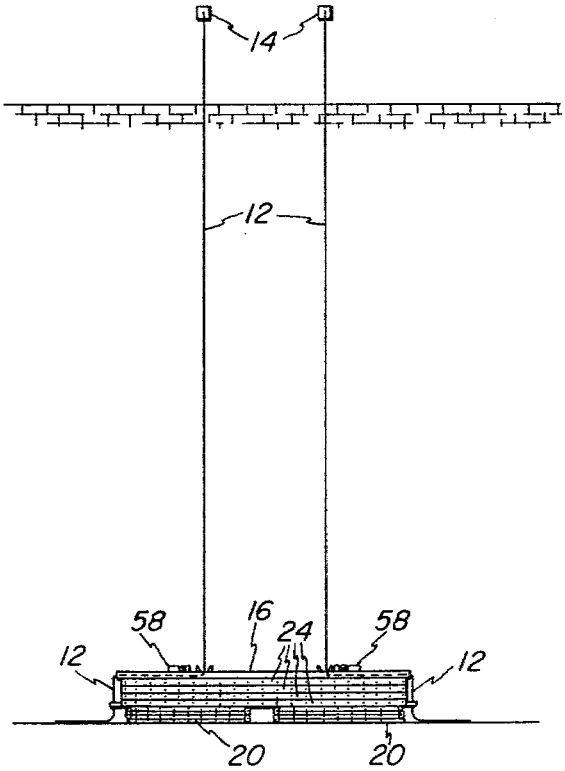
FIGS. 2B, 2C, 2D and 2E show the sequence of operations followed in using the invention to erect a multi-stage scaffold.

End support columns 18 are generally similar in construction to end support sections 20, although they are somewhat shorter in length. The length of end support columns 18 is long enough, however, to span the thickness of all of the work platforms 24 when they are stacked one on top of another. This construction and the linking arrangement between each of the end sections 20 permits the scaffolding system 10 to be collapsed and folded into a bundle, as shown in FIGS. 2A and 2B. In this configuration, each guardrail 62 may be stowed on its associated platform 24 within the space defined by flooring 30 and kick plates 26, as shown in FIG. 2A.

Figure 2C:
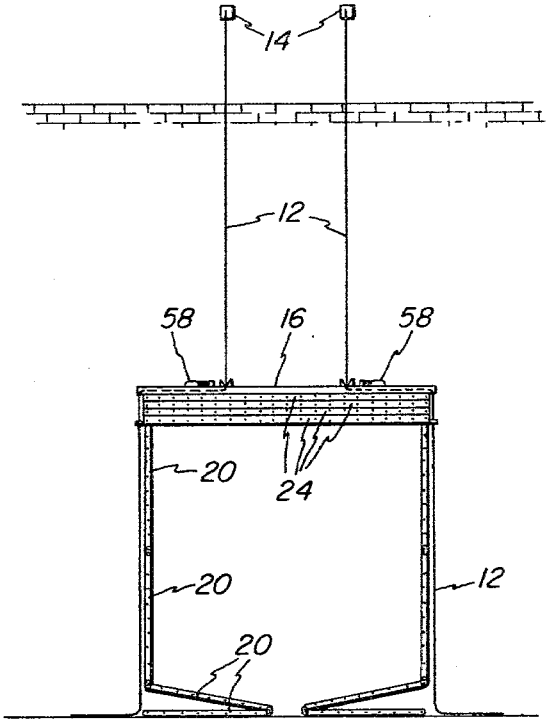

The operation of the invention is generally shown in the sequence of FIGS. 2B, 2C, 2D and 2E. Referring first to FIG. 2B, scaffold system 10 is shown in the collapsed and folded state as a generally rectangular bundle with the work platforms 24 stacked on top of the folded end support sections 20. Cables 12 are threaded through hoists 58 and around sheaves 60 from which they may extend to the ground. The lowest platform 24 is pinned at each end to end support columns 18. Hoists 58 are then operated so as to draw cables 12 through themselves in a direction which will cause beam 16 to rise. When a sufficient height has been achieved, as shown in FIG. 2C, the bottom platform is clamped to cable 12 and unpinned from end support column 18. In this condition, the stack of platforms 24 is supported only by cables 12. At this point, it is important to understand that cable 12 is not being drawn to or lowered from booms 14. In other words, the cable is not moving. Rather, beam 16, through the use of hoists 58, climbs upwardly along cables 12 while the cables stand still.

Figure 2D:
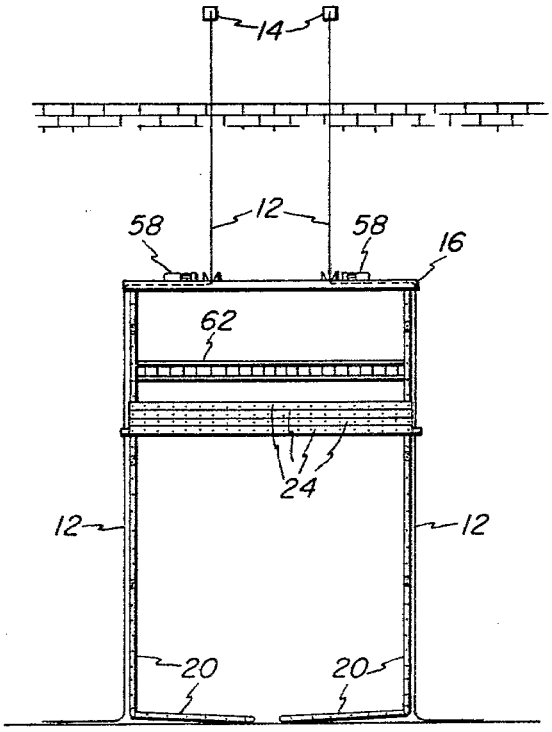
Figure 2E:
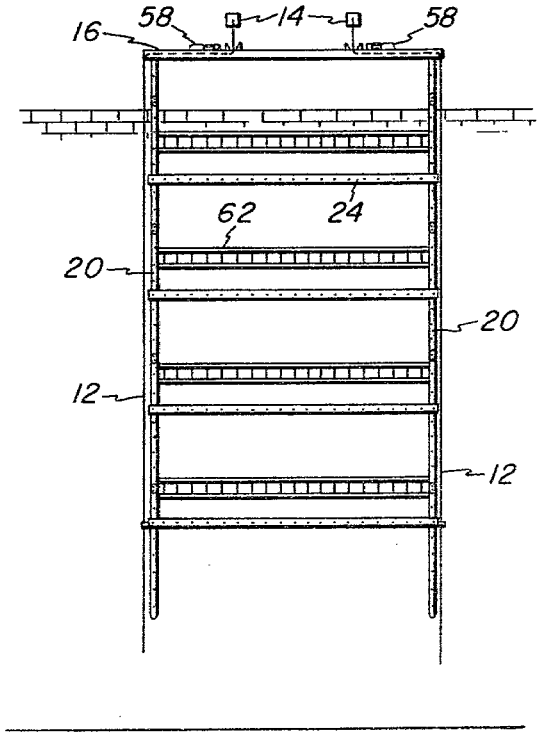

Next, hoists 58 are again operated until beam 16 is raised a suitable distance above the top work platform 24 and stoped, as shown in FIG. 2D. Since the work platforms are supported only by the unmoving cable, they remain at the same height above the ground while the beam 16 and the chains of end support sections 20 are drawn upwardly. Top work platform 24 is then pinned to its associated end support section 20 and guardrail 62 is fastened in place. Hoists 58 are again operated causing beam 16 to be raised still higher, thereby drawing the chains of end support sections 20 upwardly as well. This time, top platform 24 will also be raised since it is pinned to its end support section 20. The remaining three platforms remain at the same level, however, since they are supported by the bottom platform 24 which is clamped to the unmoving cables 12. When the top work platform has moved a sufficient distance upwardly from the next work platform, the hoists 58 are stopped, then the second work platform is pinned to its associated end support section 20 and its guardrail 62 is attached. This process is repeated until all of the work platforms have been pinned at the desired intervals to their associated end support sections 20.

The details of links 22 are shown in FIG. 3. It will be noted that rounded end members 64 are bolted at each end of each end support section 20. Link 22 is comprised of a pair of link plates 66 pivotally connected by means of axles 70 through suitable holes in rounded end members 64, said axles being held in place by hitchpins 68.

Guardrails 62 are attached to end support sections 20 by means of draw brackets 72. Each draw bracket has a lower crossbar 74 which passes through an end rung of guardrail 62, guardrail 62 being essentially a ladder-like structure. Upper crossbar 76 is joined to lower crossbar by bolts 78. A threaded thumb screw 80 passes through upper crossbar 76 and presses against the flange of end support section 20. By turning thumb screw 80 inwardly sufficiently, guardrail 62 can be drawn tightly against end support section 20. The cumulative effect of so attaching all guardrails 62 is to substantially stiffen and stabilize the entire scaffold structure. One side of upper crossbar 76 is provided with an opening to permit its associted bolt 78 to be removed laterally therefrom. When disconnecting a guardrail 62, this permits upper crossbar 76 to be pivotally rotated at its other end after thumb screw 80 has been loosened sufficiently. Then the entire draw bracket 72 can be rotated 180° about lower crossbar 74 so as to be brought within the end of guardrail 62. The free end of upper crossbar 76 can then be rotated and reattached to the associated bolt 78. This arrangement permits the draw brackets to be stowed entirely within the confines of their associated guardrails 62.

To disassembly scaffold system 10, the reverse of the procedure described above is followed. First, the bottom platform 24 is clamped to the cable. Then power hoists 58 are operated so as to lower support beam 16 and end support sections 20. The lowest work platform 24, being clamped to the unmoving cable 12 will stay at the same level. When the next higher work platform reaches it, this second work platform can be unpinned from its end support section 20 since it can then be supported by the lower platform 24. This process is repeated until support beam 16 rests on the top of the uppermost work platform 24. The lowest work platform 24 can then be pinned to end support columns 18 and unclamped from cables 12. During this disassembly procedure, the end support sections 20 are, of course, folded and stacked as they are lowered beneath the level of the bottom work platform 24. At this point, the scaffold system will be back in the form of the bundle shown in FIGS. 2A and 2B. The bundle can be conveniently banded with standard banding tools to keep it together. It can be noted that the bundle contains everything needed for the assembly and erection of the scaffold system. No tools are required and there are no additional parts to be located before assembly.

It is possible to change the level of an individual work platform 24 while the system is in its assembled state, as shown in FIG. 1. This is accomplished by clamping the selected work platform 24 to cables 12 and unpinning that platform from end support sections 20. Then the hoists 58 can be operated in the desired direction while the clamped work platform remains at the same level. Guardrail 62 would, of course, need to be adjusted accordingly.

Obviously, the scaffold system 10 can be raised or lowered in its fully assembled state simply by operating hoists 58 while none of the work platforms are clamped to cables 12 or by raising or lowering cables 12 in any conventional manner.

There are clearly many modifications which could be made to the system just described without departing from the essence of the invention. Cables 12, for example, could as well be chains and hoists 58 would be modified accordingly. Also, end support sections 20, work platforms 24 and guardrail 62 need not necessarily be ladder-like in construction. Also, the booms 14 could be spread further apart from one another, particularly where they are not connected to a mobile roof unit. Then, although applicant has not acutally done so, it would appear to be possible to eliminate end support beam 16 and mount hoists 58 directly on end support columns 18. Various other modifications could be made without departing from the spirit of the invention. It is intended to encompass all such modifications and changes within the scope of the following appended claims.

What is claimed is:

1. A scaffold system to be suspended on a pair of cables extending downwardly from a pair of suspension points through the space to be scaffolded comprising:

an end support beam extending substantially horizontally between the cables;

means attached to the beam for gripping each cable and selectively moving the beam upwardly and downwardly thereon;

a chain of end support sections foldably linked to each end of the support beam so as to hang downwardly therefrom, each chain having a plurality of end support sections therein foldably linked together in an end to end relationship;

a plurality of work platforms extending substantially horizontally between the chains of end support sections and movable vertically independently of said chains; and first means for selectively and individually connecting each work platform to each chain and cable at selected levels thereon.

2. The invention of claim 1 wherein the support beam includes a pair of end support columns connected at either end of the support beam so as to hang downwardly therefrom, said columns being of a length exceeding the thickness of the plurality of work platforms when stacked one on top of another and wherein second means are provided for releasably connecting at least one work platform to the end support columns at a selected level and wherein the chains of end support sections are foldably linked to the lower end of each end support column.

3. The invention of claim 1 or 2 wherein the length of each end support section is short enough to permit each chain to be foldably collapsed and stacked side by side under and substantially in alignment with support beam.

4. The invention of claim 3 wherein the first connecting means is comprised of a cable clamp releasably attached to each cable and having a bracket attached thereto adapted to be releasably and supportably attached to a work platform.

5. The invention of claim 4 wherein the cable gripping means is comprised of a motorized grip hoist.

6. The invention of claim 5 wherein the end support sections are provided with end support holes, the brackets are provided with bracket support holes and the platforms are provided with structural support holes adapted to be aligned with the end support holes and cable support holes adapted to be aligned with the bracket support holes and wherein the first connecting means are further comprised of pins adapted to be inserted into the aligned holes.

7. The invention of claim 6 further comprising a guardrail associated with each work platform and means for rigidly securing the guardrails horizontally at selected levels between the chains of end support sections.

8. The invention of claim 7 wherein the work platforms are provided with kick plates on either side along the length thereof and wherein the guardrails are sized to be stored in the space defined by the work platforms and the kick plates.

9. The invention of claim 8 wherein the guardrail securing means are operable to a position entirely within the confines of the guardrails so as to be stowable therein.

10. A scaffold system to be suspended on a pair of cables extending downwardly from a pair of suspension points through the space to be scaffolded comprising:

a chain of end support sections foldably linked to one another in an end to end relationship and running substantially vertically along each cable;

means attached to the upper end of each chain for gripping its associated cable and selectively moving the chain upwardly and downwardly thereon;

a plurality of work platforms extending substantially horizontally between the chains of end support sections and movable vertically and independently of said chains; and first means for selectively and individually connecting each work platform to each chain and cable at selected levels thereon.

11. The invention of claim 10 wherein each top end support section is an end support column being of a length exceeding the thickness of the plurality of work platforms when stacked one on top of another and wherein second means are provided for releasably connecting at least one work platform to the end support columns at a selected level and wherein the chains of end support sections are foldably linked to the lower end of each end support column.

12. The invention of claim 10 or 11 wherein the length of each end support section is short enough to permit each chain to be foldably collapsed and stacked side by side under and substantially in alignment with the plurality of work platforms when collapsed and stacked one on top of another.

13. The invention of claim 12 wherein the first connecting means is comprised of a cable clamp releasably attached to each cable and having a bracket attached thereto adapted to be releasably and supportably attached to a work platform.

14. The invention of claim 13 wherein the cable gripping means is comprised of a motorized grip hoist.

15. The invention of claim 14 wherein the end support sections are provided with end support holes, the brackets are provided with bracket support holes and the platforms are provided with structural support holes adapted to be aligned with the end support holes and cable support holes adapted to be aligned with the bracket support holes and wherein the first connecting means are further comprised of pins adapted to be inserted into the aligned holes.

16. The invention of claim 15 fuerther comprising a guardrail associated with each work platform and means for rigidly securing the guardrails horizontally at selected levels between the chains of end support sections.

17. The invention of claim 16 wherein the work platforms are provided with kick plates on either side along the length thereof and wherein the guardrails are sized to be stored in the space defined by the work platforms and the kick plates.

18. The invention of claim 17 wherein the guardrail securing means are operable to a position entirely within the confines of the guardrails so as to be stowable therein.

19. A method for suspending a foldable scaffold system on a pair of cables extending downwardly from a pair of suspension points through the space to be scaffolded comprising the steps of:

foldably linking two pluralities of end support sections together end to end in two chains to be suspended substantially vertically on and along the cables;

attaching means to the top of each chain for gripping each cable and selectively moving the chain selectively upwardly and downwardly thereon;

providing a plurality of work platforms extending substantially horizontally between the cables; and providing means for selectively and individually connecting each work platform to each chain and cable at selected levels thereon.

20. The method of claim 20 wherein the attaching step comprises providing an end support beam having cable gripping and moving means thereon and attaching the top of each chain to an end of the beam.

* * * * *